US005358033A

United States Patent [19]

Schlitt

[11] Patent Number: 5,358,033

[45] Date of Patent: Oct. 25, 1994

[54] HEAT PIPE, WITH A COOLED BUBBLE TRAP

[75] Inventor: Reinhard Schlitt, Bremen, Fed. Rep. of Germany

[73] Assignee: ERNO Raumfahrttechnik GmbH, Bremen, Fed. Rep. of Germany

[21] Appl. No.: 158,422

[22] Filed: Nov. 29, 1993

[30] Foreign Application Priority Data

Nov. 28, 1992 [DE] Fed. Rep. of Germany ..... 4240081

[51] Int. Cl.[5] ..... F28D 15/02

[52] U.S. Cl. ..... 165/104.26; 165/104.14; 165/104.27; 122/366

[58] Field of Search ..... 165/104.26, 104.14, 165/104.27; 122/366

[56] References Cited

U.S. PATENT DOCUMENTS

| | | | |
|---|---|---|---|
| 3,618,660 | 11/1971 | Busse | 165/104.14 |
| 4,422,501 | 12/1983 | Franklin et al. | 165/104.26 |
| 4,627,487 | 12/1986 | Basiulis | 165/104.26 |
| 4,941,527 | 7/1990 | Toth et al. | 165/104.26 |

OTHER PUBLICATIONS

"Heat Pipe Design Handbook", pp. 149 and 152 B&K Engineering, Inc.

*Primary Examiner*—Albert W. Davis, Jr.
*Attorney, Agent, or Firm*—W. G. Fasse; W. F. Fasse

[57] ABSTRACT

A heat pipe structure, especially for cooling in a spacecraft, is equipped with a main heat pipe and at least one smaller diameter auxiliary heat pipe arranged so that the main and auxiliary pipes are in thermal contact with each other at the evaporator end of the main heat pipe. The condenser end of the auxiliary heat pipe, or pipes, is connected in a heat exchange manner with an auxiliary radiator or heat exchanger which is smaller than and thermally insulated from a main heat exchanger, the latter being in thermal contact with the condenser end of the main heat pipe. The auxiliary heat pipe, or pipes, super cools a bubble trap in the main heat pipe for removing of gas and/or vapor bubbles from the liquid flow path of the main heat pipe.

16 Claims, 2 Drawing Sheets

HEAT PIPE, WITH A COOLED BUBBLE TRAP

CROSS-REFERENCE TO RELATED APPLICATION

This application relates to application Ser. No. 158,411, filed Nov. 29, 1993 "HEAT PIPE WITH A BUBBLE TRAP, filed simultaneously with the present application now Pat. No. 5,346,000 granted Sep. 13, 1994.

FIELD OF THE INVENTION

The invention relates to a heat pipe which is particularly suitable for removing heat from a spacecraft.

BACKGROUND INFORMATION

Heat pipes comprise at least one heat conveying pipe filled with a heat carrier, also referred to as medium. At least one flow channel for the liquid phase of the medium and one flow channel for the vapor phase of the medium are provided in the heat conveying pipe. Heat pipes are also equipped with features for removing bubbles from the liquid flow channel. Furthermore, at least one radiator or heat exchanger is connected to the heat pipe in a heat exchanging contact.

As mentioned, heat pipes for the transport of heat are known, especially from their use in space technology. These heat pipes operate by evaporating the medium at a heat receiving end of the heat pipe and then transporting the vapor to a heat discharging end of the heat pipe where the vapor is condensed again and returned to the evaporating end of the pipe. The medium is conventionally ammonia. As the vapor condenses at the heat discharging end of the pipe, the latent heat stored in the vapor is discharged to the surroundings of the spacecraft while the condensate being formed flows back to the heat receiving evaporating end of the pipe. The transport of the vapor from the evaporating end to the condensing end is a normal compression flow while the flow of the liquid from the condensing end to the evaporating end is a capillary flow. Different radii of curvature along the boundary surface between the liquid and the vapor at the evaporating end of the pipe on the one hand, and at the condensating end of the pipe on the other hand, and the capillary forces caused by these different radii, result in a pressure difference in the direction from the condensating end of the pipe toward the evaporating end of the pipe and this pressure difference maintains the required flow. The resulting flow velocity is established by the equilibrium between the pressure loss due to friction forces and the effective pressure difference of the capillary forces.

Modern high performance heat pipes are capable of transporting heat quantities within the range of about 1 kw over distances between 1 and about 20 m, even at relatively low temperature differences between the evaporating and condensating ends of the pipe.

Comparing these high performance heat pipes with other conventional heat pipes, the higher power of the high performance heat pipes is achieved, due to the fact that the transport of the liquid takes place in channels having differing dimensions. On the one hand, in the evaporating area of the pipe, a plurality of very small channels are provided which extend in the circumferential direction and which have capillary geometries in order to achieve large capillary driving forces. On the other hand, the guidance of the flow in the condenser area and return flow path of the pipe, there are only a few flow channels or even a single flow channel having a relatively large diameter. These few channels or the single channel are also referred to as "artery channels". In this manner friction caused pressure losses are minimized and a substantially larger fluid mass flow is achieved with the same capillary forces as are present in normal heat pipes. As a result of the substantially larger fluid mass flow, a substantially higher heat flow is also achieved.

However, a substantial problem is encountered in the operation of such high performance heat pipes in that the function of these high performance heat pipes is substantially adversely affected or may even be totally interrupted when bubbles are formed of the medium vapor or of gaseous non-condensable contaminations in the artery channels. These contaminations could have been present in the heat pipe already at the time of putting the heat pipe into service or these contaminations could have been generated, for example, by an operational overloading of the heat pipe, such as could occur by an overheating of the evaporator end when a short duration complete drying of the evaporator end of the heat pipe should occur. These bubbles can even interrupt the transport of the heat carrier fluid to the heat take-up or evaporator zone so that the heat take-up zone even dries further and thus the heat pipe becomes inoperative, in other words, ceases to function properly.

In a publication "Heat Pipe Design Handbook", Volume 1, by E & K Engineering, Inc., Towsen, Md., 21204, pages 147 to 153, and especially pages 149 and 152, two heat pipes are described with features for removing bubbles, and thus for avoiding blockage of the fluid flow by these gas bubbles. In one of the conventional heat pipes, the gas bubbles are removed by the arrangement of venting bores in the boundary wall between the artery and the vapor flow channel. In the other conventional construction the bubble removing feature includes a Venturi nozzle which is arranged in the transport channel for the vapor and which simultaneously functions as a jet pump for sucking off any gas bubbles that may be present in the artery.

A disadvantage of having venting bores in the boundary wall between the artery and the vapor channel, is seen in the fact that during the operation of the heat pipe, the pressure in the vapor channel is substantially higher than in the artery. As a result, it is necessary to interrupt the operation of the heat pipe for transferring gas bubbles from the artery into the vapor channel. However, during such interruption of the operation, the venting bores are covered by liquid bridges which block the passage of gas bubbles through these venting bores unless these liquid bridges are first evaporated. As a result, these interruptions of the operation of the heat pipe require a relatively long time duration for the gas bubble removal before the heat pipe can be returned to its normal operation.

The arrangement of a Venturi nozzle in the vapor channel has the following disadvantage. If there happens to be no gas bubble in the suction zone of the nozzle, a small quantity of heat carrier medium tends to collect in the suction pipe of the nozzle and this medium is taken out of the artery. If now a gas bubble appears in fact in front of the suction opening of the Venturi nozzle, it is necessary to first remove the liquid accumulated in the suction pipe before the bubble can be sucked out of the artery. As a result of this procedure, there is a substantial pressure loss in the flow through the suction pipe which correspondingly results in a substantial pressure loss in the Venturi pipe. Stated differently, this Venturi pipe must be constructed to have a relatively substantial reduction in its flow cross-sectional area. This requirement in turn leads to a substantial impairment of the vapor flow due to the pressure loss, whereby the working capacity of the heat pipe is respectively reduced.

OBJECTS OF THE INVENTION

In view of the foregoing it is the aim of the invention to achieve the following objects singly or in combination:

- to construct a heat pipe, especially for use in a spacecraft, in such a way that vapor bubbles of the heat carrier medium as well as bubbles formed by a non-condensible gas are simply, rapidly, and efficiently removed without the need for interrupting the normal operation of the heat pipe;
- the removal of any kind of gas bubbles from the flow channel shall be possible even if the gas bubbles occupy the larger proportion of the flow cross-sectional area in the respective flow channel already before placing the heat pipe into operation;
- the removal of such bubbles must also be efficiently accomplished even when the bubbles have been generated by an overload of the evaporation end of the heat pipe; and
- to cool especially a bubble trap in a heat pipe for an improved efficiency in the bubble removal.

SUMMARY OF THE INVENTION

The above objects have been achieved according to the invention in a heat pipe arrangement that comprises in addition to a main heat pipe at least one, preferably two auxiliary heat pipes. The auxiliary heat pipe is connected with its evaporator end in a heat transferring contact with the evaporator end of the main heat pipe. The condenser end of the auxiliary heat pipe is thermally coupled to a second radiator or heat exchanger. The second radiator or heat exchanger is arranged so as to be thermally separated or insulated from a main first heat exchanger or radiator that is thermally connected to the main heat pipe. The auxiliary heat pipe cools a bubble trap.

The foregoing combination of features according to the invention is tolerant to faults to a high degree, especially with regard to overloads that may occur during operation of the heat pipe according to the invention, because the present combination substantially simplifies and accelerates a restarting of the heat pipe after the evaporator end has dried out. An important advantage of the present heat pipe resides in the fact that it is now possible to remove all types of undesirable bubbles, not only vapor bubbles, but also bubbles of non-condensable gases from the liquid flow channel.

BRIEF DESCRIPTION OF THE DRAWINGS

In order that the invention may be clearly understood, it will now be described, by way of example, with reference to the accompanying drawings, wherein.

DETAILED DESCRIPTION OF A PREFERRED EXAMPLE EMBODIMENT AND OF THE BEST MODE OF THE INVENTION

Figure 1:
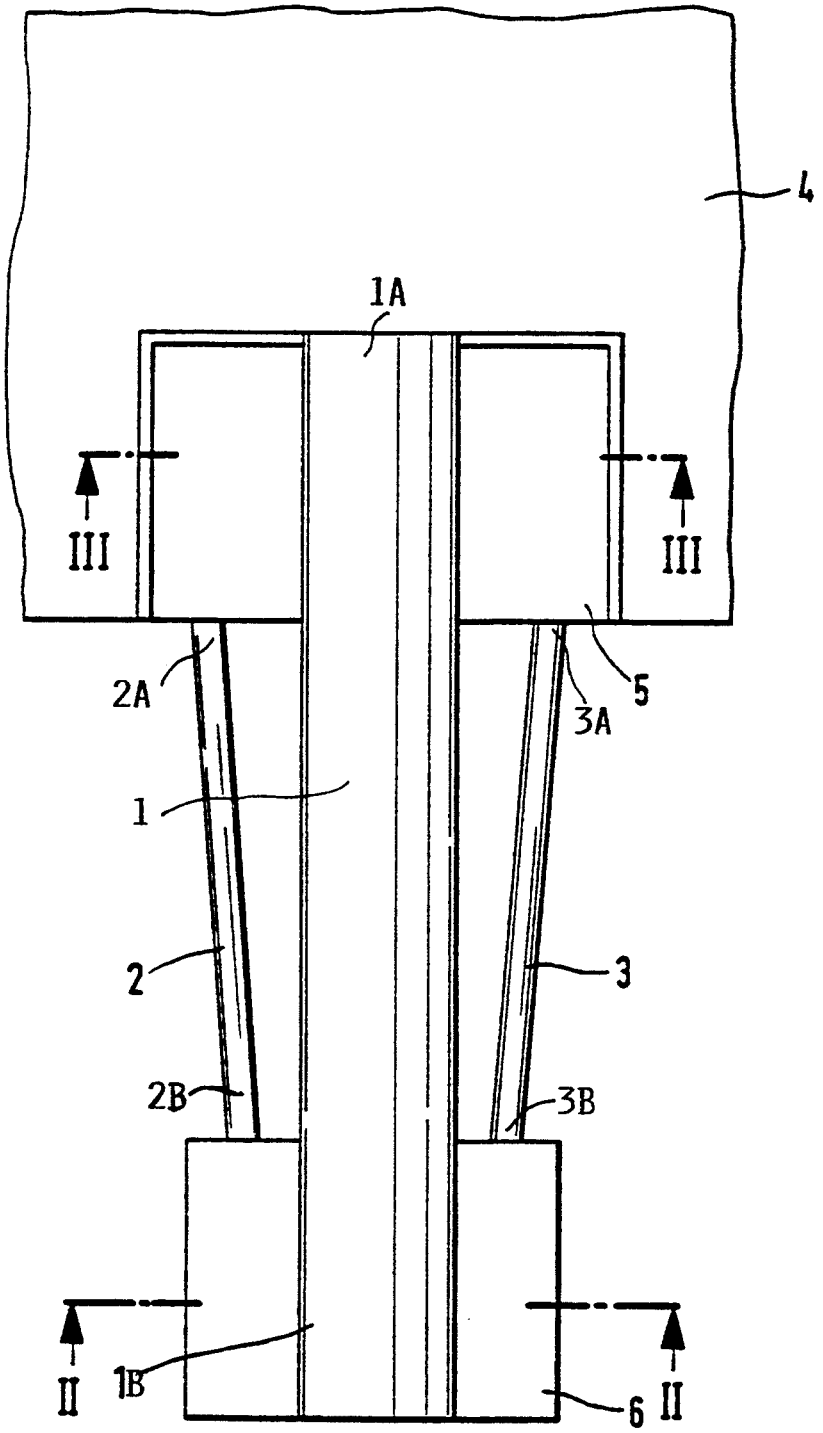
FIG. 1 is a top plan view of a heat pipe arrangement according to the invention for the removal of heat from one location and discharge of removed heat at another location.

Referring to FIG. 1, the heat pipe arrangement according to the invention comprises a main heat pipe 1 having a condensor end 1A and an evaporator end 1B. The arrangement further includes two auxiliary heat pipes 2 and 3 and two heat exchangers or radiators 4, 5. The larger heat radiator 4 of the two radiators is the main radiator which is in direct thermal contact with the condensor end 1A of the main heat pipe 1. The second substantially smaller auxiliary radiator 5 is thermally separated from the main radiator 4 as shown by a spacing S in FIG. 3. If desired, the spacing S may be filled with a suitable thermal insulation between the two radiators 4, 5 or heat exchangers. Heat pipes 2, 3 have respective condenser ends 2A, 3A and evaporator ends 2B, 3B.

Figure 2:
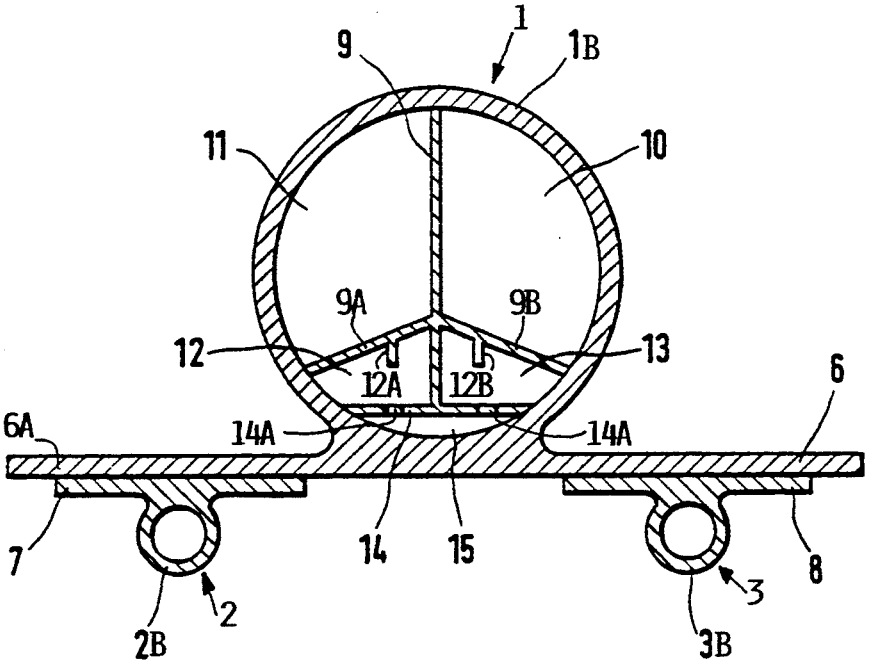
FIG. 2 is a sectional view along section line II—II in FIG. 1, illustrating the construction of the evaporator end or heat take-up end of the present arrangement.
Figure 3:
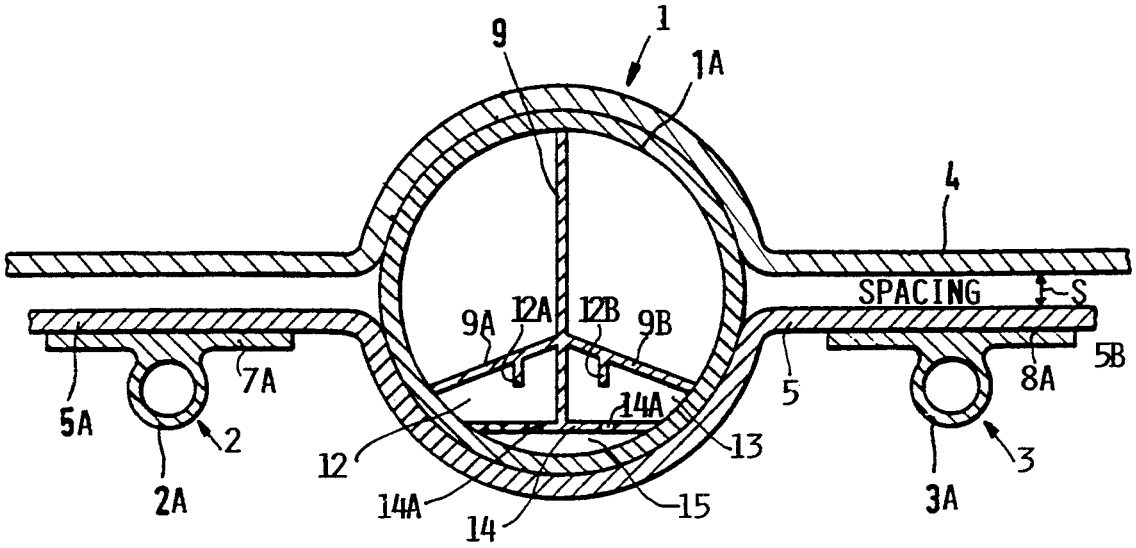
FIG. 3 is a sectional view along section line III—III in FIG. 1, illustrating the construction of the condenser end of the present heat pipe arrangement.

As seen in FIG. 3, the auxiliary radiator 5 is positioned with its surface areas or heat exchange fins 5A, 5B in direct thermal contact with the condenser or heat discharge ends 2A, 3A of the two auxiliary heat pipes 2 and 3. These auxiliary heat pipes 2 and 3 have a substantially smaller cross-sectional flow area than the main heat pipe 1. As shown in FIG. 2, the evaporator or heat take-up ends of the auxiliary pipes 2 and 3 are thermally coupled with the respective evaporator heat take-up end of the main heat pipe 1. For this purpose, the main heat pipe 1 is provided with heat transfer fins 6, 6A. The fin 6A is in a heat transfer contact with the surface of a fin 7 of the auxiliary heat pipe 2. The other heat transfer contact fin 6 is in surface area contact with a fin 8 of pipe 3. The heat transfer fins 6, 6A are formed as integral elements of the main pipe 1. The contact fin 7 is formed preferably as an integral component at the evaporator end 2B of the auxiliary heat pipe 2. Similarly, the contact fin 8 is formed preferably as an integral component at the evaporator end 3B of the auxiliary heat pipe 3. Similar heat transfer contact fins 7A, 8A are formed, preferably integrally, at the condenser ends 2A, 3A of the respective auxiliary heat pipes 2 and 3 for contacting the fins 5A, 5B of the radiator 5.

FIGS. 2 and 3 further show the inner construction of the main heat pipe 1 which is divided by a partition wall 9 into two liquid flow channels 10 and 11. These channels 10 and 11 are also referred to as arteries. The partition wall 9 has lower sections 9A and 9B flaring at an angle outwardly to form vapor flow channels 12 and 13. A further liquid flow channel 15 is formed directly below the vapor flow channels 12 and 13 by a sheet metal member 14 with perforations 14A forming an end element of the partition wall 9. The additional liquid flow channel 15 serves as a trap for gas and/or vapor bubbles that may be present in the liquid flow from the condenser end to the evaporator end of the main heat pipe 1.

Gas or vapor bubbles that are present in the evaporator or heat take-up end of the heat pipe 1 are resolved in that any condensate present in the channels 12, 13 or 15 is super-cooled by pipes 2, 3. Such gas or vapor bubbles may be present in the evaporation zone of the heat pipe 1, for example, due to an adverse fluid distribution even prior to putting the heat pipe in service while the spacecraft is in orbit or these bubbles may have been generated by a temporary overload. Such bubbles may also have been transported into the evaporator zone of the heat pipe 1 through the channels 12, 13, or 15. The super-cooling of the fluid present in the channels 12, 13 or 15 is accomplished with the aid of the auxiliary heat pipes 2 and 3 which are connected with the auxiliary heat exchanger or radiator 5 and which assure the additional heat discharge necessary for the super-cooling of the condensate.

Although the invention has been described with reference to specific example embodiments, it will be appreciated that it is intended to cover all modifications and equivalents within the scope of the appended claims.

What I claim is:

1. A heat pipe structure comprising a main heat pipe (1) having a first heat absorbing evaporator end (1B) and a first heat discharging condenser end (1A), at least one auxiliary heat pipe (2 or 3) having a second heat absorbing evaporator end (2B) and a second heat discharging condenser end (2A), said main heat pipe having at least one liquid flow channel for liquid evaporant and at least one vapor flow channel for vaporized evaporant, a first heat exchanger (4) in thermal contact with said first heat discharging condenser end (1A) of said main heat pipe, thermal conductor means (6) thermally interconnecting said first and second heat absorbing evaporator ends of said main heat pipe and of said auxiliary heat pipe, a second heat exchanger (5) thermally connected to said second heat discharging condenser end of said auxiliary heat pipe, thermal insulator means (S) thermally insulating said first (4) and second (5) heat exchangers from each other, and a bubble trap (15) arranged for collecting gas and/or vapor bubbles from said liquid flow channel of said main heat pipe, said auxiliary heat pipe cooling said bubble trap for removing said bubbles.

2. The heat pipe structure of claim 1, wherein said main heat pipe has a diameter that is larger than a diameter of said auxiliary heat pipe.

3. The heat pipe structure of claim 1, wherein said second heat exchanger (5) is dimensioned substantially smaller than said first heat exchanger (4).

4. The heat pipe structure of claim 1, further comprising at least two auxiliary heat pipes (2, 3) each having a respective evaporator end and a respective condenser end, and thermal conductor fins (7A, 8A) thermally connecting said condenser ends of said two auxiliary heat pipes (2, 3) to said second heat exchanger or radiator (5) having respective heat transfer surface fins (5A, 5B).

5. The heat pipe structure of claim 4, wherein said two auxiliary heat pipes are arranged symmetrically relative to said main heat pipe.

6. The heat pipe structure of claim 1, wherein said bubble trap comprises a perforated sheet metal member inserted between said bubble trap and said at least one liquid flow channel, said sheet metal member having perforations therein communicating said bubble trap with said at least one liquid flow channel of said main heat pipe.

7. The heat pipe structure of claim 1, further comprising a divider member (9) extending longitudinally in said main heat pipe, said divider member dividing said main heat pipe into two vapor flow channels (10, 11), into two liquid flow channels (12, 13), and into said bubble trap (15).

8. The heat pipe structure of claim 7, wherein said divider member comprises a central element, two side elements (9A, 9B), and an end element (14), said central element and said two side elements bounding said two vapor flow channels, said end element (14) and said two side elements bounding said two liquid flow channels, said end element (14) bounding said bubble trap inside said main heat pipe.

9. The heat pipe structure of claim 8, wherein said divider member is an extruded component.

10. The heat pipe structure of claim 8, wherein said end element (14) has perforations therein for communicating said bubble trap with said liquid flow channels.

11. The heat pipe structure of claim 1, wherein said thermal conductor means (6) comprise at least one first heat transfer element (6) thermally connected to said heat absorbing first evaporator end (1B) of said main heat pipe (1) and a respective second heat transfer element (7) thermally connected to said second evaporator end of said auxiliary heat pipe, said first and second heat transfer elements being in surface area contact with each other for an efficient heat transfer between said evaporator ends (1B, 2B).

12. The heat pipe structure of claim 11, comprising two auxiliary heat pipes (2, 3), wherein said main heat pipe (1) has an omega-sectional configuration at its evaporator end (1B), said omega-sectional configuration having two legs (6, 6A) extending away from said main heat pipe in opposite directions, each of said auxiliary heat pipes (2, 3) also having an omega-sectional configuration at said respective evaporator end (2B, 3B) with respective legs (7, 8) in heat transfer contact with a respective leg of said two legs of said main heat pipe omega-configuration.

13. The heat pipe structure of claim 12, wherein said heat transfer legs of said omega-sectional configurations extend substantially tangentially to said main heat pipe and to said auxiliary heat pipes.

14. The heat pipe structure of claim 1, wherein said second heat exchanger (5) has a sectional trough configuration with at least one rim (5A) along a side of said trough configuration, said trough configuration being in heat transfer contact with said condenser end (1A) of said main heat pipe (1), said auxiliary heat pipe having an omega-sectional configuration at said second condenser end (2A), said omega-sectional configuration having legs in heat transfer contact with said rim of said trough sectional configuration.

15. The heat pipe structure of claim 14, comprising two auxiliary heat pipes each having an omega-sectional configuration with respective legs (7A, 8A), said trough sectional configuration of said second heat exchanger having two rims (5A, 5B), each of said legs (7A, 8A) being in heat transfer contact with one of said two rims of said trough sectional configuration.

16. The heat pipe structure of claim 1, wherein said thermal insulator means comprise a spacing (S) between said first and second heat exchangers (4, 5) at said condenser end (1A) of said main heat pipe (1).

* * * * *